US007225706B2

(12) United States Patent
Kassabian

(10) Patent No.: US 7,225,706 B2
(45) Date of Patent: Jun. 5, 2007

(54) TOOL FOR HOSE CLAMPS

(75) Inventor: Todd Michael Kassabian, South Brunswick Township, NJ (US)

(73) Assignee: Rotor Clip Company, Inc., Somerset, NJ (US)

( * ) Notice: Subject to any disclaimer, the term of this patent is extended or adjusted under 35 U.S.C. 154(b) by 0 days.

(21) Appl. No.: 11/422,124

(22) Filed: Jun. 5, 2006

(65) Prior Publication Data

US 2006/0278044 A1 Dec. 14, 2006

Related U.S. Application Data

(63) Continuation-in-part of application No. 11/365,570, filed on Mar. 1, 2006, now abandoned.

(60) Provisional application No. 60/689,002, filed on Jun. 9, 2005.

(51) Int. Cl.
*B25B 17/10* (2006.01)

(52) U.S. Cl. ..... 81/9.3; 81/485; 81/486; 29/243.56

(58) Field of Classification Search ..... 81/9.3, 81/485, 486; 29/235, 237, 239, 243.56; 140/93.2, 140/93.4
See application file for complete search history.

(56) References Cited

U.S. PATENT DOCUMENTS

| | | | | |
|---|---|---|---|---|
| 1,039,096 | A * | 9/1912 | Christenson | 81/9.3 |
| 4,162,640 | A | 7/1979 | Arnold | |
| 4,368,569 | A | 1/1983 | Van Dam, Jr. | |
| 4,919,017 | A | 4/1990 | Thomas | |
| 5,125,296 | A | 6/1992 | Nelson et al. | |
| 5,209,143 | A | 5/1993 | Sweet | |
| 5,253,554 | A * | 10/1993 | Riera et al. | 81/9.3 |
| 5,507,206 | A | 4/1996 | Solski | |
| 6,038,744 | A | 3/2000 | Zielinski | |
| D429,614 | S | 8/2000 | Ploeger | |
| 6,098,251 | A | 8/2000 | Zielinski | |
| 6,128,975 | A | 10/2000 | Schley et al. | |
| 6,164,162 | A * | 12/2000 | Furundzic | 81/9.3 |
| D436,814 | S | 1/2001 | Gore | |
| 6,170,360 | B1 | 1/2001 | Smith | |
| 6,213,140 | B1 | 4/2001 | Ploeger | |
| 6,389,930 | B1 | 5/2002 | Gore | |
| 6,634,258 | B2 | 10/2003 | Pool et al. | |
| 6,981,432 | B2 * | 1/2006 | Williford et al. | 81/9.3 |
| 2002/0178869 | A1 | 12/2002 | Pool et al. | |
| 2003/0033909 | A1 | 2/2003 | Gore | |
| 2005/0044992 | A1 | 3/2005 | Williford et al. | |
| 2006/0278043 | A1 * | 12/2006 | Kassabian | 81/9.3 |

* cited by examiner

*Primary Examiner*—Hadi Shakeri
(74) *Attorney, Agent, or Firm*—Norris, McLaughlin & Marcus

(57) ABSTRACT

A tool for releasing hose clamps. Also, methods for installing a hose to a device with the tool to release a clamp from an expanded state to a relaxed state. The tool has a curved end having an arcuate convex curved section with an arcuate surface having an uppermost point opposite to a bottom plane of the curved end wherein the curved end is capable of fitting juxtaposed to the outer surface of the hose when the clamp is released.

16 Claims, 13 Drawing Sheets

TOOL FOR HOSE CLAMPS

CROSS-REFERENCE TO RELATED APPLICATION

This is a continuation-in-part application of U.S. patent application Ser. No. 11/365,570 filed Mar. 1, 2006, now abandoned, which application claims the benefit of U.S. Provisional Patent Application No. 60/689,002 filed Jun. 9, 2005. U.S. patent application Ser. No. 11/365,570 and U.S. Provisional Patent Application No. 60/689,002 are incorporated herein in their entirety by reference.

BACKGROUND OF THE INVENTION

1. Field of the Invention

The invention relates to a tool for releasing hose clamps, including self-compensating hose clamps. The invention further pertains to a methods for installing a hose to a device using the tool and releasing a clamp from an expanded state.

2. The Related Art

Hoses are generally used in engine compartments of vehicles and other machines or devices for fluid transport. For example, hoses may be used for the transfer of fluid, such as coolant for engines or motors, or to supply heated coolant to coils for providing heat to the interior of a vehicle. Hoses which are intended to be used with low pressurized fluids necessitate the use of a clamp to prevent disconnection and to maintain a fluid tight seal during use. Generally circular hose clamps are used so that the hose is reliably clamped by the inherent spring force designed into the construction of the clamp. Recently, however, there is a trend towards hose clamps supplied in a pre-expanded state to facilitate its application and to increase the efficiency of the hose assembly connection process. Hoses may have such clamps attached to one or more ends of the hose for easy installation and application during manufacture of an automobile, vehicle, device or other piece of machinery.

Hose clamps have various designs and come in many sizes, such as the hose clamps described in U.S. Pat. No. 6,098,251, which is incorporated herein in its entirety by reference. Hose clamps may comprise a clamp body having a ring shaped or annular main section and first and second terminal ends formed outwardly relative to the main section having a first terminal end and a second terminal end which are releaseably engageable with each other to releaseably hold the clamp in an expanded state and being disengageable with each other to release the clamp from the expanded state. When released, the size of the annular opening decreases and thereby secures the hose to a functional element by applying radial pressure to the hose. Several means have been described in the art to releaseably hold the clamp body in an expanded state. Examples of these means are corresponding U-shaped notches, such as those described in U.S. Pat. No. 6,098,251, raised edges which temporarily hold the terminal ends in a relative position, retainer pieces which hold the terminal ends proximate to one another and clasp assemblies.

Hose connections in automobile engines and other machines and devices in which hoses are used may be in locations that are difficult to access during both the manufacture and repair of the vehicle, machine or device. For example, hose connections in automobiles are generally at an engine block water jacket point near the bottom of an engine block. These locations are frequently difficult to work at and inspect to see if the clamp has properly engaged. If a clamp is not properly engaged, a watertight seal is not formed between the hose and the engine block. Hoses are also used for coolant systems and failure of the hose clamp connection in a cooling system can lead to devastating damage to the vehicle such as coolant leaks, engine overheating, head of an engine block warping and engine failure.

Tools and other apparatuses have been developed in the art to install hoses with clamps having engaged ends that are released to secure the hose to the functional element of an operating system. Screw drivers have been used to release the terminal ends and special pliers or similar type devices have been developed. Many conventional tools do not comprise a method or mechanism which reliably confirms that the terminal ends of the clamp are released thereby securing the hose. Furthermore, many conventional tools are fixed and cannot be adjusted or rotated to facilitate access to clamps in hard to reach locations. Tools in the art also do not have any means for applying the tool square to the hose clamp. If the tool is not applied square, that is if the hose clamp tool is not applied at about 90° from the outer circumference of the hose, the clamp may shift when the terminal ends are released, thus negatively affecting the nature of the seal between the hose and the functional member which could cause the hose to become dislodged during operation of the vehicle. Finally, many of the devices and tools in the art may have hazards associated with their use, such as retaining members or other pieces of the hose clamps becoming dislodged and projected out of the immediate work area where they can come into contact with people, causing injury, and the tools themselves may experience kickback during or after release of the terminal ends thereby potentially causing injury.

SUMMARY OF THE INVENTION

The invention is a tool for releasing the terminal ends of clamps. The tool comprises a first body having an end which has a curvature adapted to fit over an object having a curved outer surface, such as a hose. The first body comprises a bottom opening proximate to the end having curvature, i.e., the curved end, which is capable of fitting over the outer surface of the hose clamp, including the area of the hose clamp where the terminal ends are releaseably engaged, when the tool is placed on or over a hose and clamp. The bottom opening may further comprise one or more bottom opening restricted spaces. The first body also comprises one or more ports which accommodate and engage one end of the second body.

The first body further comprises one or more annular openings which correspond to the ports. The annular openings extend from the ports to an internal cavity within the first body, which is proximate to the bottom opening. A releasing means is housed within the internal cavity. The releasing means is capable of causing at least one, or possibly both, terminal ends of a clamp to move and thereby release the clamp from an enlarged engaged position to a relaxed position wherein it applies pressure to the hose to secure the hose to a functional element. For example, the releasing means may comprise an element that is urged to come into contact with one or both terminal ends of the hose clamp thereby releasing the terminal ends from the engaged position.

The second body comprises first and second ends and an annular inner tube. The tool further comprises and the second body of the tool preferably comprises the actuating means. The second body is capable of engaging one or more ports of the first body. Whenever the second body is attached to the first body, the annular inner tube is adjacent to and axially aligned with one of the annular openings of the first part which enables the actuating means to move within the first body to engage the releasing means. One end of the second body, the attaching end, is capable of engaging the one or more ports of the first body. The attaching end and the one or more ports of the first body comprise means to releaseably secure the second body to the first body. Such means include, but are not limited to, bolts or screws with corresponding threaded bore holes, screws, screw threads, friction fittings, latches, pins, nuts and bolts, hook and loop (VELCRO® type) fasteners and the like, The attaching end is generally open, having an attaching end opening defined by the annular inner tube wall at the attaching end. The end of the second body opposite the attaching end, i.e., the first end, is generally closed either by an integral top or a cap, which may further comprise a means to activate (i.e. activating means) the actuating means, or provide access for the activating means to activate the actuating means.

The actuating means generally comprises a component which is urged to contact the element of the releasing means that comes into contact with the clamp. For example, the actuating means may comprise an inner annular shaft with a piston element contained therein that is capable of movement within the inner annular shaft such that one end of the piston element comes into contact with the releasing means to cause the releasing means to come into contact with one or more terminal ends of the clamp. In another embodiment, the actuating means may, for example, comprise a shaft and a linkage member wherein one end of the shaft is attached proximate to an end of the linkage member and an opposite end of the linkage member is attached to the element of the releasing means that contacts the clamp such that movement of the shaft causes the linkage element to move which causes the element of the releasing means that contacts the clamp to move and contact the clamp.

The activating means include physical means, such as manual operation, or electronic means, such as a solenoid having solenoid extension which urges the actuating means to move towards the releasing means, or itself functions as the actuating means wherein the solenoid extension directly contacts the element of the releasing means that contacts the clamp. The activating means may be pneumatic means, such as using pressurized air to urge the actuating means; like directing pressurized air into the inner annular shaft to move the piston element in the direction of releasing means pivoting element after the pivoting element has contacted the clamp and released the terminal ends.

After the terminal ends of the hose clamp are released, the releasing means returns to its original position and urges the actuating means in the direction opposite the releasing means. For example, when a piston element is used with a pivoting element, the piston element will move within the contiguous annular opening and annular inner tube towards the first end of the second body, by action of the pivoting element. When a linkage is used, the element of the releasing means that contacts the clamp is urged to return to its original position which in turn causes the linkage element and shaft to return to their original positions. When used in this specification, the term original position shall mean, with reference to a moving part, approximately the position of the moving part prior to its initial movement when performing a function for the tool.

The tool may further comprise a sensor that indicates that the engaged terminal ends of the clamp are released. The sensor may be at the bottom opening. For example, the sensor may be proximity switch which senses that one or more of the terminal ends have moved in the bottom opening. Other examples are strain gauges and light sensors. A strain gauge, for example, may be secured to the releasing means of the tool. The sensor may be hard wired to a processing unit or be capable of wireless transmission of data to the processing unit. The data will indicate to the user whether the tool has disengaged the terminal ends of the clamp.

The tool is used in a method for releasing engaged terminal ends of a clamp to allow the clamp to adjust to its relaxed state. In the method, a hose and clamp are provided, either as a single part with the hose clamp secured to the hose in the desired position or as separate components. The hose and clamp are positioned on a functional element, such as an engine block port. The second body is releaseably secured to the first body in a port which facilitates access to the hose and clamp within the work area, i.e., the location where the hose and clamp need to be applied to the functional element. The end of the first body with curvature is placed over the hose proximate to the clamp such that the clamp body of the hose clamp is within the bottom opening. After the tool is placed over the hose, the actuating means is activated to actuate the releasing means which causes the releasing means to contact at least one terminal end of the clamp thereby releasing the terminal ends allowing the clamp to move to the relaxed position. After the terminal ends are released the tool is removed from the hose.

DETAILED DESCRIPTION OF THE INVENTION

Figure 1:
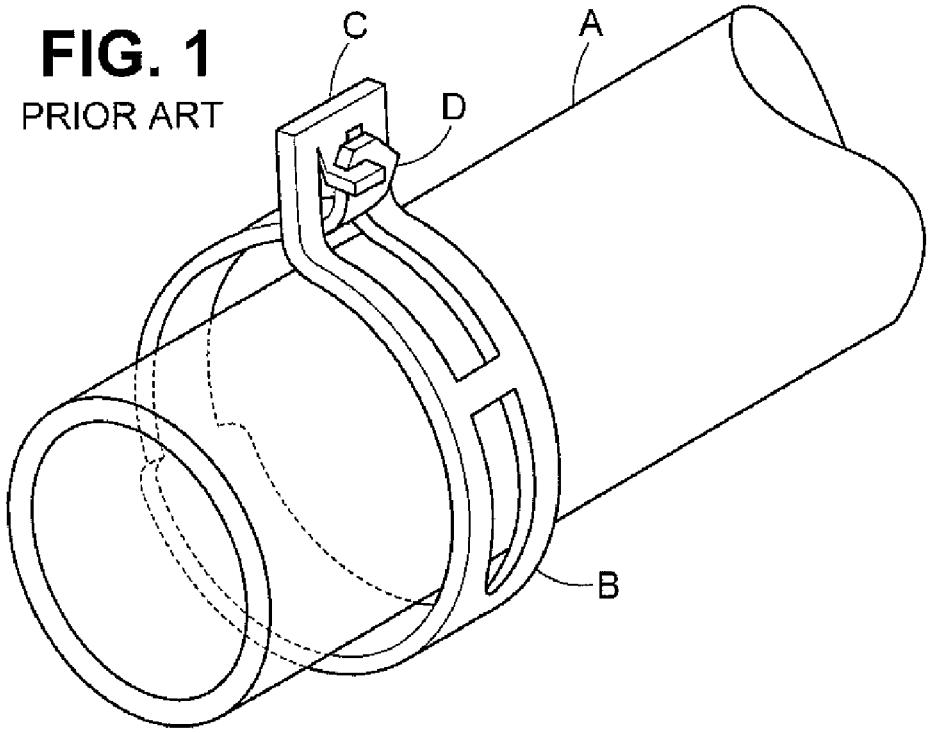
FIG. 1 PRIOR ART
FIG. 1 is a perspective view of a clamp having the terminal ends engaged with the clamp in an expanded state around a hose.

The tool generally comprises a first body and a second body. The first body and a second body may be releaseably attached to each other. However, an embodiment of the invention wherein the first and second bodies are secured to each other or are part of one or more integral pieces is within the scope of the invention. Also, in an embodiment of the invention, the first body may comprise one or more interchangeable pieces. In a further embodiment, the tool may comprise a port element that is capable of rotational movement along the surfaces and top of the first body such that a single port and the second body may be aligned in one or more configurations depending on the desired attachment location of the second body.

The first body may have any geometric shape, such as cylindrical, rectangular, square, or any shape having a plurality of surfaces. In the embodiments of the invention shown in the drawings, however, the first body is generally cylindrical having a first end, a second end and a continuous outer wall. The second end, i.e., the curved end, comprises a convex curved section. The convex curved section has an arcuate surface with an uppermost point, i.e. the point on the arc furthest from and opposite the bottom plane of the curved end, in an axial direction.

Figure 2:
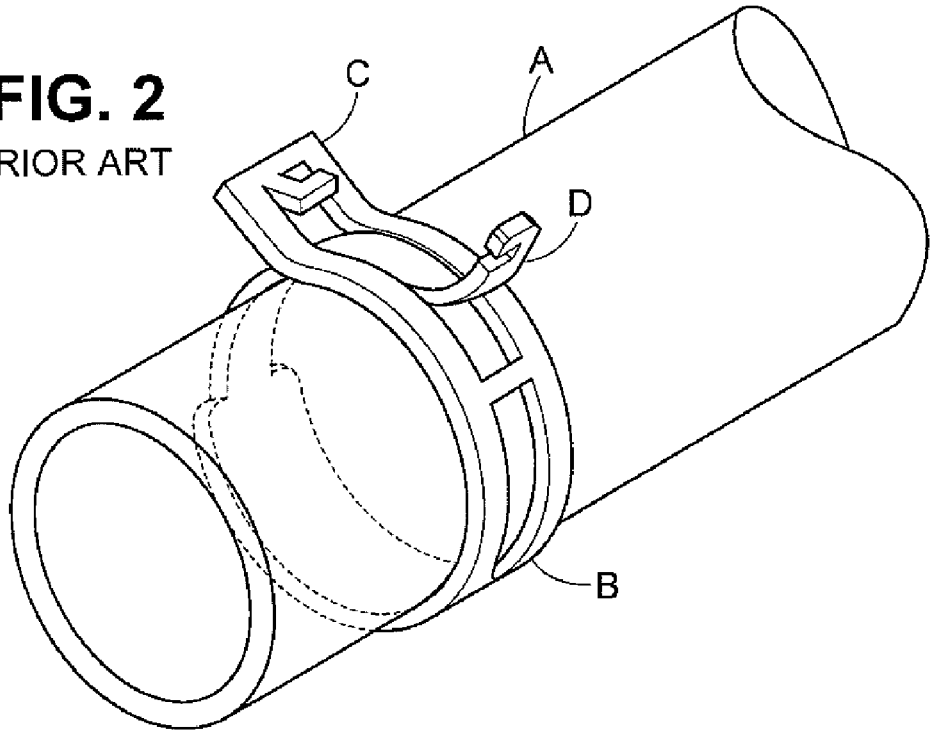
FIG. 2 PRIOR ART
FIG. 2 is a perspective view of a clamp having the terminal ends disengaged with the clamp in a relaxed state around a hose and applying radial pressure to the hose.

The tool is used to release the terminal ends of a hose clamp. FIG. 1 shows a hose A having a hose clamp B around the outer circumference of the hose A with a first terminal end C engaged with a second terminal end D using corresponding V-type notches. In FIG. 2 to terminal ends (C, D) have been released and the hose clamp B is in the relaxed position applying radial pressure to the hose A.

Figure 3:
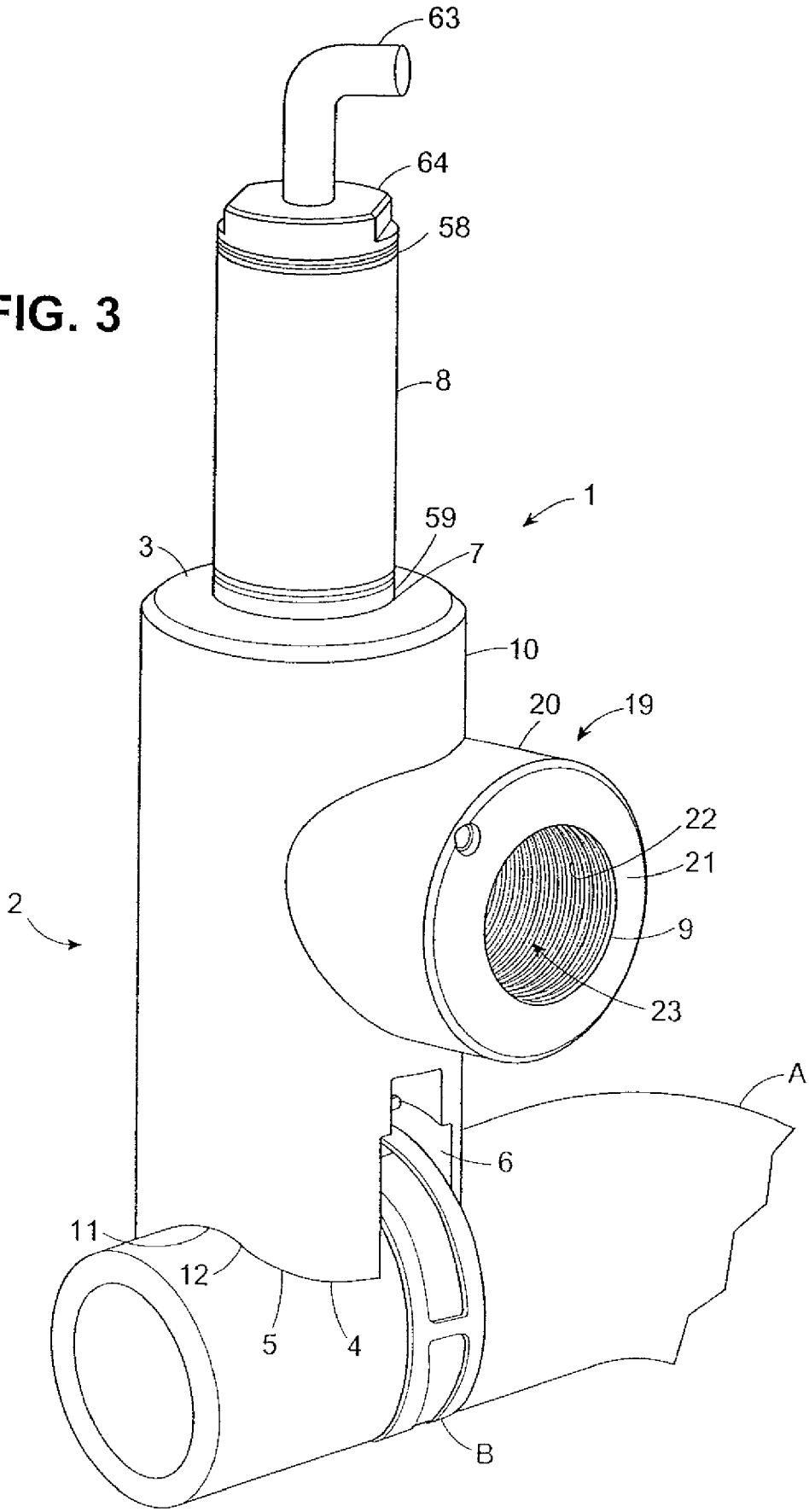
FIG. 3 is a perspective view of a tool in accordance with an embodiment of the invention placed over a hose having a clamp proximate to the bottom opening with the second body releaseably secured to the first body at a port at a first end of the first body.
Figure 4:
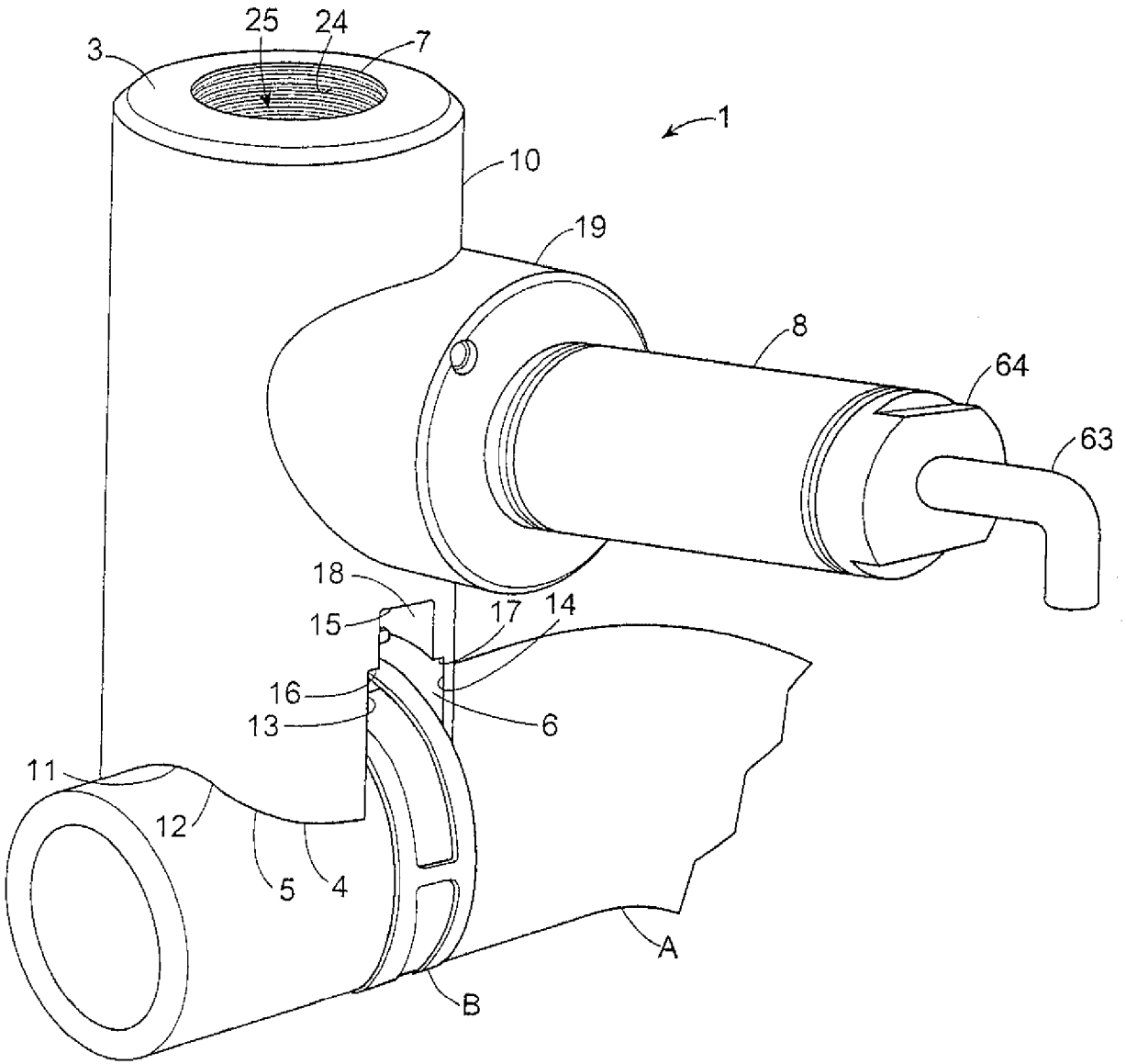
FIG. 4 is a perspective view of a tool in accordance with an embodiment of the invention placed over a hose having a clamp proximate to the bottom opening with the second body releaseably secured to the first body at a port within a port casing along the continuous outer wall of the first body.

FIG. 3-6 shown on embodiment of the invention wherein the tool 1 comprises a first body 2 having a first end 3 and a second end 4 having a curved section 5 and bottom opening 6 at the second end. The tool has a first port 7 for engaging the second body 8 at the first end of the first body, and a second port 9 for engaging the second body 8 along the outer wall 10 of the first body. FIG. 3 illustrates the second body 8 engaged with the first port 7, and FIG. 4 illustrates the second body 8 engaged with the second port 9.

As shown in FIG. 3-4 the bottom opening 6 is proximate to the second end 4 (which is also referred to herein as the curved end) which is about perpendicular to the axial direction of the uppermost point of the convex curved section. Preferably, the bottom opening extends beyond the uppermost point 11 of the convex curved section 12, with the bottom opening 6 defined by bottom opening forward wall 13, bottom opening distal wall 14 and a bottom opening upper wall 15. The bottom opening may be continuous from one location on the circumferential outer wall 10 of the first body 2 to an opposing point on the opposite side of the circumferential outer wall 10 of the first body 2.

The first body 2 may comprise one or more bump outs in the bottom opening. For example, the first body may comprise one or more bump outs proximate to the bottom opening upper wall 15 which may function as a stop member when the tool is placed over the hose and to align the terminal ends with the releasing means. In the embodiment of the invention, as shown in FIGS. 3-4, the first body may comprise a pair of mutually opposed bump-outs, a forward bump-out 16 and a distal bump-out 17 which are adjacent, respectively, to the bottom opening forward wall 13 and bottom opening distal wall 14 proximate to the bottom opening upper wall 15, thereby defining a bottom opening upper restricted space 18, in the axial direction of the bottom opening and the bottom opening upper restricted space may extend to the opposite point on the outer wall or may extend from one point on the outer wall of the first body in an axial direction corresponding to the bottom opening but not extending to an opposite point on the outer wall.

In a further embodiment of the invention, the first body comprises an upper bump out proximate to the bottom opening upper wall and a lower bump out proximate to the bottom plane of the curved section. In this embodiment the upper bump out is adjacent to a wall of the bottom opening and the lower bump out is adjacent to the opposite wall of the bottom opening. For example, if the upper bump out is on the bottom opening distal wall then the lower bump out is on the bottom opening forward wall, and if the upper bump out is on the bottom opening forward wall then the lower bump out is on the bottom opening distal wall. The upper bump out, opposing bottom opening distal or forward wall and the bottom opening upper wall defines an upper bottom opening restricted space, which acts as a stop element and/or aligns the clamp with the releasing means, and the lower bump out and opposing bottom opening distal or forward wall define a lower bottom opening restricted space which accommodates a narrowing section on the body of some clamps to further restrict movement of the clamp when the terminal ends are released.

The first body further comprises one or more ports for engaging the second body. As discussed above, in the embodiment of the invention depicted in FIGS. 3-7, the first body comprises two ports. The first port 7, is located proximate to the first end 3 of the first body, i.e. opposite the curved end, and the second port 9 is located along the continuous outer wall 10 of the first body. The second port is within a port casing 19 which protrudes from the continuous outer wall of the first body aligned in the same axial plane as the bottom opening 6. The second port casing, as shown particularly in FIG. 3, comprises a second port casing outer continuous surface 20, a second port casing end 21 and an inner wall 22 which defines an annular opening 23 which comprises the means for releaseably securing the second body to the first body. The second port is located along the continuous outer wall such that annular opening extends in an axial direction from the port to a point proximate to the portion of the internal cavity opposite to the bottom opening. As shown in FIG. 4, the first port 7 likewise has an inner wall 24 which defines an annular opening 25 that comprises means for releasably securing the second body to the first body. Thus, each port comprises an annular opening which, as discussed below, accommodates a mating member of the second body and comprises the means for releaseably securing the first body to the second body. In the embodiment of the invention shown in the drawings, the annular openings comprise screw threads for releaseably securing the second body to the first body.

The first body further comprises one or more annular channels which are defined by inner annular channel walls that extend axially from the annular opening of each port to an internal cavity located within the first body. As shown in the drawings, particularly FIG. 7, the first body may comprise a first inner annular channel 26 defined by a first inner annular channel wall 27 which extends in an axial direction from the 29 annular opening of the first port 25 to the internal cavity 28 and a second inner annular channel 29 defined by a second inner annular channel wall 30 which extends in an axial direction from the annular opening of the second port 23 in an axial direction to the internal cavity 28, such that all or part of the second inner annular channel is within the port casing 19 of the first body.

Figure 5:
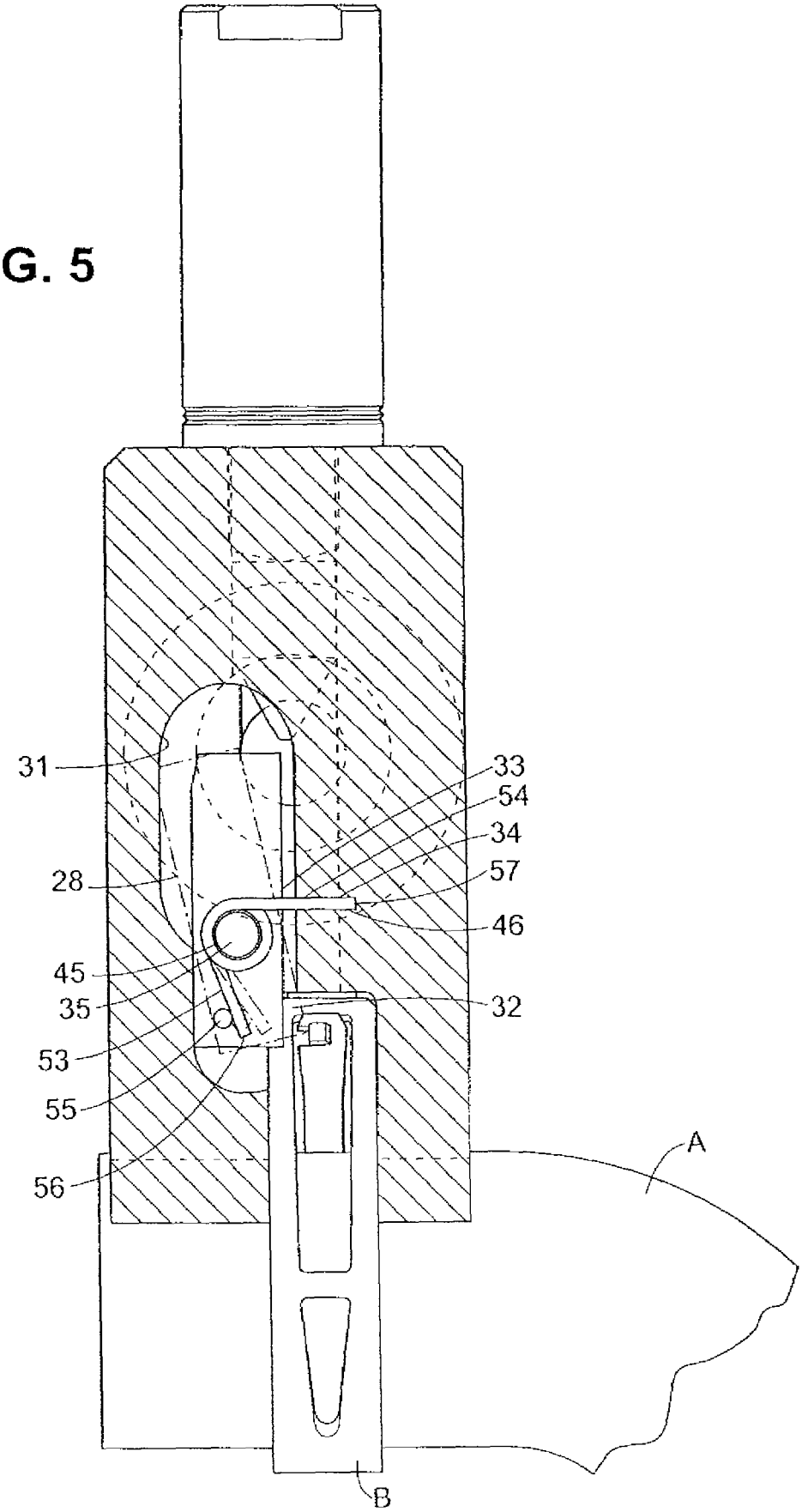
FIG. 5 is a cross sectional view of a tool in accordance with an embodiment of the invention placed over a hose having a clamp proximate to the bottom opening with the dotted lines showing the capable movement of the moving parts of the releasing means.
Figure 6:
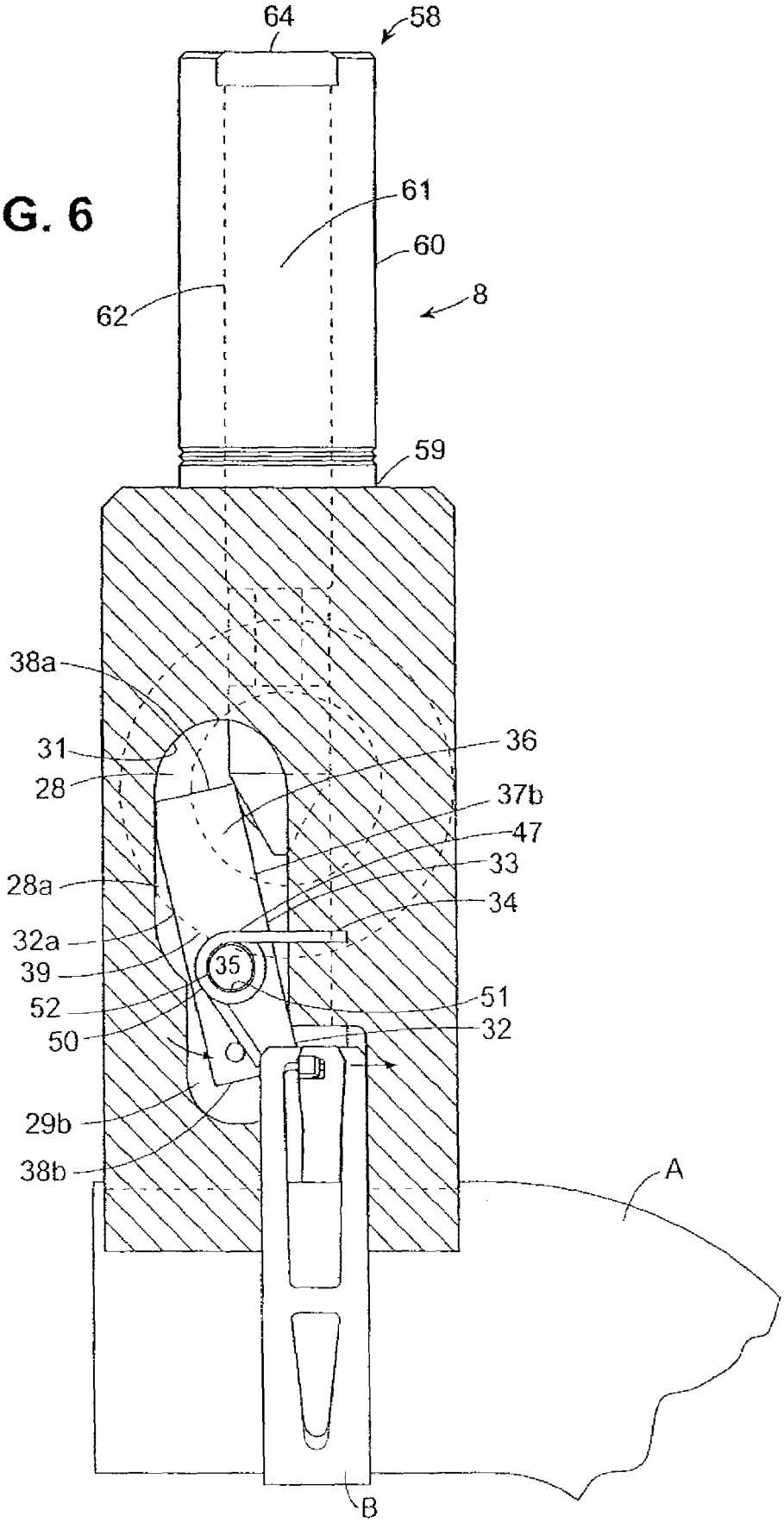
FIG. 6 is a cross sectional view of a tool in accordance with an embodiment of the invention placed over a hose having a clamp proximate to the bottom opening showing the releasing means immediately after impacting one or more terminal ends of the clamp with the terminal ends of the clamp disengaged.

Referring now to FIGS. 5 and 6, the internal cavity 28 is defined by an internal cavity wall 31 and is located proximate to the bottom opening and generally extends from proximate to the bottom opening 6 to a point within the first body between the bottom opening and the first end. The internal cavity wall is discontinuous, i.e. comprises a gap 32, where the internal cavity is adjacent to the bottom opening 6 to allow the releasing means 33 to interact with the hose clamp. The releasing means 33 is preferably housed within the internal cavity.

The internal cavity may be any shape provided it is capable of housing the releasing means. In the embodiment of the invention shown in FIGS. 3-7, for example, the internal cavity has an upper oval section 28*a* and an immediately adjacent half oval section 29*b* which is proximate to the bottom opening. In the embodiment of the invention, the first body further comprises a cavity bore hole defined by a cavity bore hole wall and groove (shown as 34 in FIGS. 5 and 6) adjacent to the internal cavity. As shown in the drawings, the groove may be about perpendicular to the internal cavity wall; however, the groove may be in any orientation.

The releasing means may comprise a screw 35 having a screw thread which mates with a screw thread in the cavity bore hole which releaseably secures the screw to the first body. An end of the screw protrudes into the internal cavity. In the embodiment of the invention shown in FIGS. 3-7, the pivoting element 36 is a rectangular piece having corresponding longer sides 37*a* and 37*b* and corresponding shorter sides 38*a* and 38*b*, with a first surface 39 and a opposing second surface (not shown) about perpendicular to each side, wherein the distance between each side surface at the corresponding longer sides and corresponding shorter sides define edges i.e., a first longer edge (shown as 40 in FIG. 7) and corresponding second longer edge (not shown) and a first shorter edge (shown as 41 in FIG. 7) and corresponding second shorter edge (shown as 42 in FIG. 7). The point where sides and edges meet form corners and in the embodiment of the invention shown in the drawings the pivoting element may have first, second, third and fourth corners. In an alternative embodiment of the invention, such as that shown in FIGS. 10 and 11, for example, the pivoting element comprises a first section 43, which may be rectangular, as generally described above and an integral adjacent extended section 44, that may be also rectangular as generally described above, which comes into contact with the clamp. The pivoting element may be any geometric shape depending on the size, shape and configuration of the first body and the internal cavity, including a square wherein each of the sides would be about equal in length to each other.

The pivoting element has a hole, defined by a pivoting element hole wall. In the embodiment of the invention shown in FIGS. 3-7, the hole 45 may be centered in the axial direction parallel to the corresponding shorter sides and slightly off-center in the axial direction parallel to the corresponding longer sides. In this embodiment, the pivoting element is located within the upper oval and half oval sections of the internal cavity, with the bore hole and screw proximate to the area where the upper oval section and half oval section are adjacent to each other. An end of the screw 35 protrudes through the hole so as to permit the pivoting element to pivot around the outer wall of the screw.

The releasing means further comprises a spring, which may urge the element that comes into contact with the clamp, such as the pivoting element, back to its original position after the one or more terminal ends of the clamp are contacted. In the embodiment of the invention shown in FIGS. 3-7, the spring 46 has a center coil 47 with a distal loop 48 and a forward loop 49. The center coil has an outer wall 50 and inner wall 51, with the inner wall defining a center coil opening 52. The spring 46 is placed with the protruding end of the screw through the center coil opening 52 such that the inner wall 51 of the center coil is about adjacent to the outer wall of the screw. The spring further comprises a distal leg 53 protruding from the distal loop, and a forward leg 54 protruding from the forward loop. The pivoting element may comprise one or more protrusions 55 on at least one surface, such as in a corner of the surface where a longer side and shorter side meet. The distal leg generally has a distal leg end 56 opposite to the distal coil which is proximate to protrusion 55. The forward leg has a forward leg end opposite 57 the forward coil which terminates in the groove 46.

The second body has a first end and an attaching end, which is capable of engaging the one or more ports on the first body. As shown in the embodiment of the invention depicted in the drawings, the second body 8 having a first end 58 and attaching end 59 may be releaseably secured to the first body by screw threads which are proximate to the attaching end 59. The second body is generally hollow having an outer wall 60 and an annular inner tube 61 defined by an annular inner tube wall 62. The second body is generally open, such that the second body comprises an attaching end opening defined by the annular inner tube wall at the attaching end. The first end of the second body, opposite the attaching end, may be open or closed. If the first end of the second body is open, the first end is preferably sealed with a cap 64, which may have a slot to insert a tool for impacting the actuating means, a pneumatic line to activate the actuating means or a solenoid. In an embodiment of the invention, such as that shown in FIGS. 3 and 4, the first end comprises a duct 63 which is capable of releaseably securing a pneumatic line to the tool.

The actuating means is housed within the annular inner tube of the second body. In the drawings, the actuating means is shown thrust into the first body to actuate the releasing means. As shown in the drawings, the actuating means 65 comprises a piston element 66 which is capable of sliding within the annular inner tube, which comprises a shaft 67, preferably a cylindrical shaft having a rearward end 68 which is proximate to the first end of the of the second body and a forward end 69 which is proximate to the attaching end. The piston element further comprises a wedge 70 having a first end 71 and a second end 72, with the first end adjacent to the forward end of the shaft. The wedge is a frustoconical element having a wedge diameter at the first end proximate to the shaft, about equal to the diameter of the shaft which wedge diameter tapers to a point or a semicircular shape at the second end of the wedge, opposite the shaft.

Figure 7:
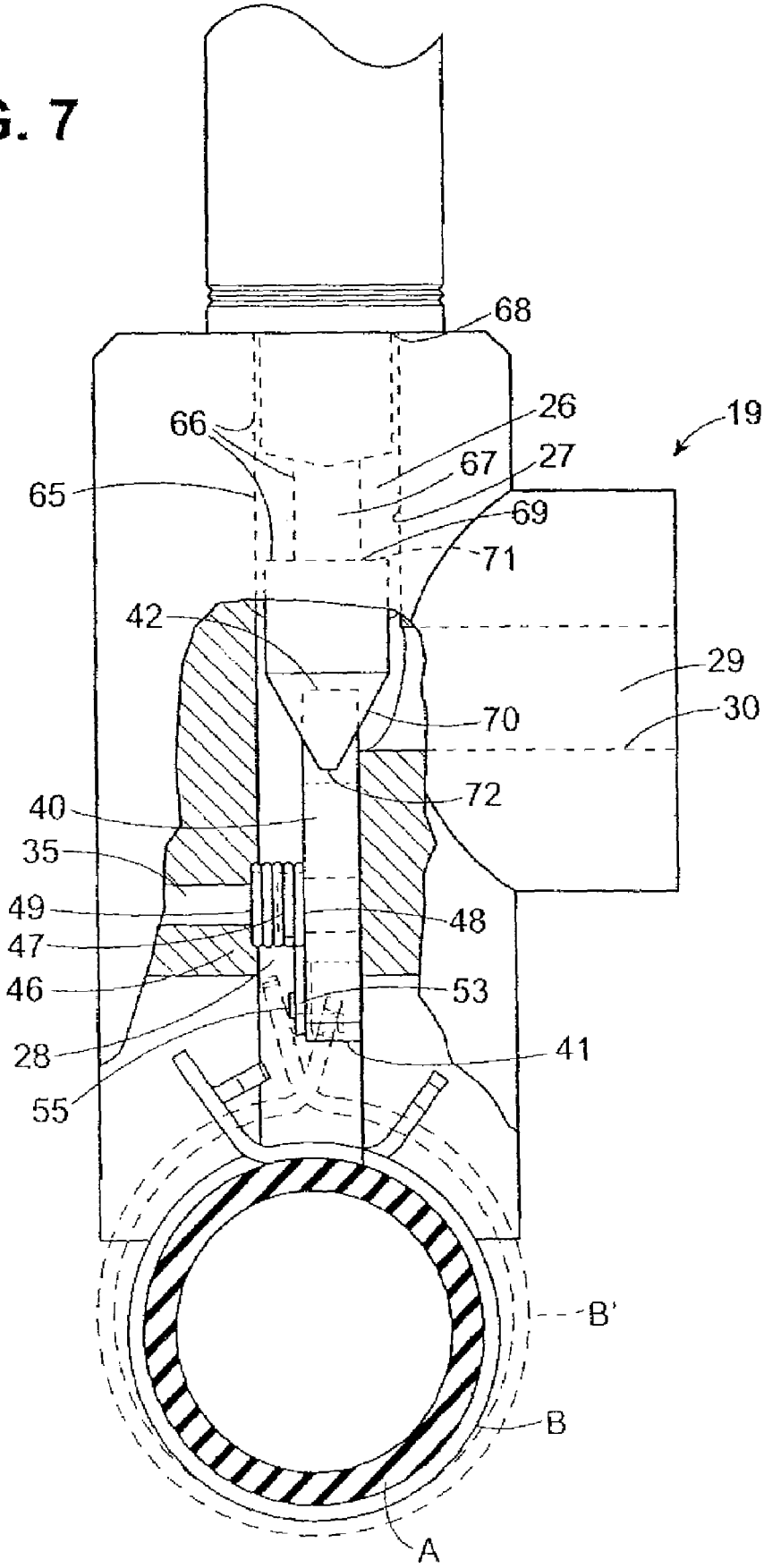
FIG. 7 is a front view of a tool in accordance with an embodiment of the invention placed over a hose having a clamp proximate to the bottom opening with a cut away showing the internal cavity and releasing means with the clamp shown in solid lines having the terminal ends disengaged and in dotted lines having the terminal ends engaged.

When the second body is secured to the first body, the annular inner tube is aligned with one of the annular channels of the first body such that the piston element is capable of sliding axially within the annular inner tube and annular channel. When the actuating means is activated, the piston element is moved towards the releasing means. The wedge is caused to impact the pivoting element which results in the pivoting element moving into the bottom opening so that the pivoting element impacts at least one of the terminal ends of the hose clamp thereby releasing the terminal ends allowing the clamp to move to the relaxed position Referring particularly to FIGS. 5-7, in the embodiment of the invention shown therein, the first longer side 37*b* and corresponding edge proximate to its intersection with the adjacent shorter side 38*b* opposite to the corner adjacent to the protuberance, impacts the clamp. The wedge 70 initially impacts the pivoting element 36 at an edge proximate to or at a corner and because the wedge has a frustoconical shape, the wedge rides along an edge, such as shown in FIGS. 6-7, the corner formed by the joining of the first longer side 37*b* and second shorter side 38*a*, of the pivoting element causing the pivoting element to move and pivot around the screw as the diameter of the wedge in contact with the pivoting element increases as the wedge rides along the pivoting element. After the clamp is impacted, the pivoting element is urged by the spring to return to its original position which causes the pivoting element to impact the wedge such that piston element slides towards the second body and returns to a position where the operation can be repeated to release additional clamps. The actuating means is effective when it is positioned axially aligned with an edge of the pivoting element, preferably axially aligned with or proximate to a corner. As such, the actuating means is effective whether the second body is releaseably secured to an end of the first body or along and about perpendicular to the continuous outer wall of the first body, provided it is located such that the piston element is free within the first body to impact the pivoting element. Thus, the tool can function having one or more configurations. Note that in FIG. 7 the clamp is shown as B' in an engaged state with the terminal ends engaged, and as B in a relaxed state with the terminal ends released after the clamp is impacted.

In an embodiment of the invention shown generally in FIGS. 8-12, the first body comprises separate interchangeable sections. It should be noted that the drawings, particularly FIGS. 8-12, show various components of the interchangeable sections or other components of the tool. These various components may be adaptable for use in other embodiments of the invention.

Figure 10:
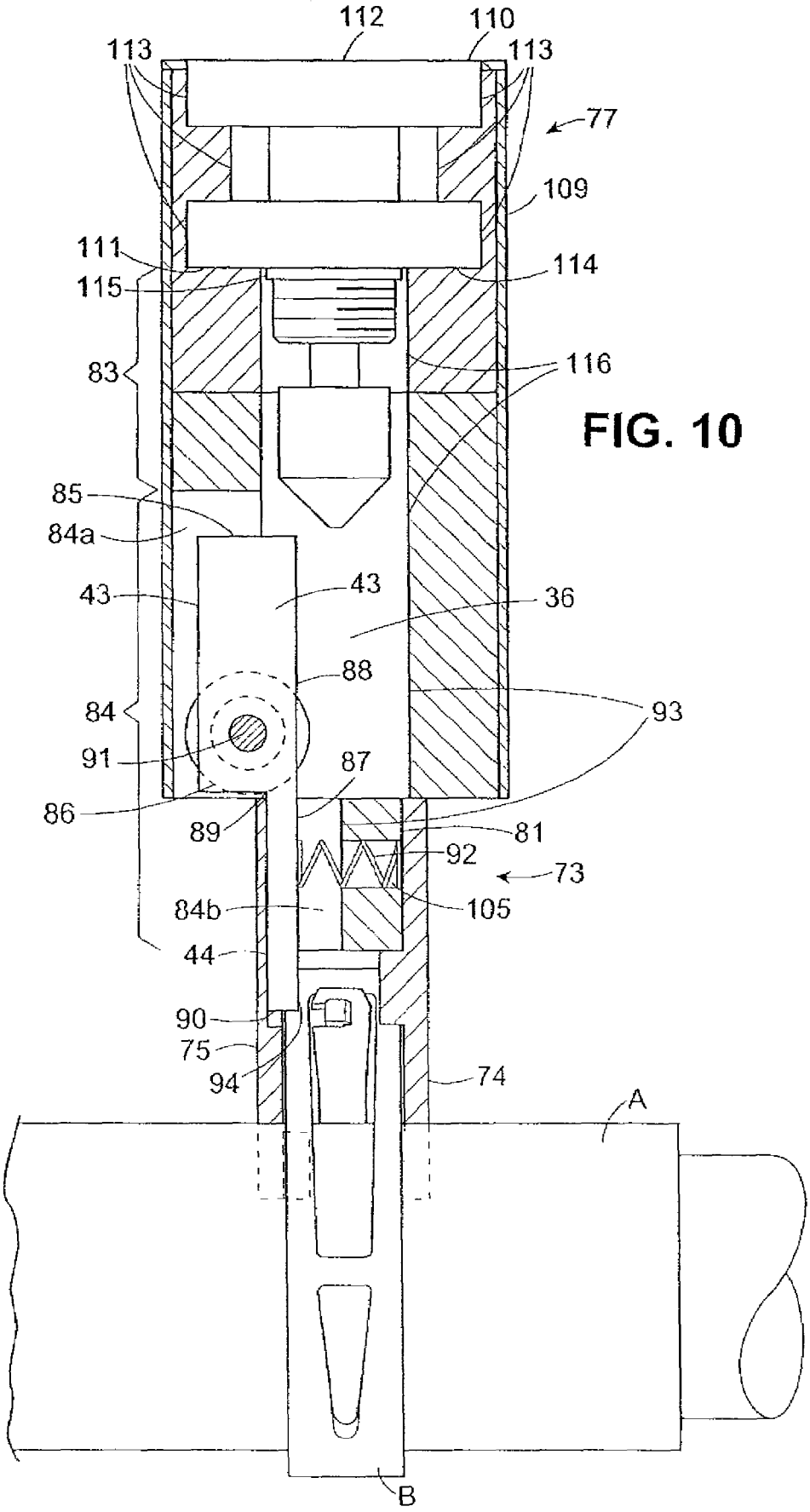
FIG. 10 is a side view of a tool in accordance with an embodiment of the invention placed over a hose having a clamp proximate to the bottom opening.
Figure 11:
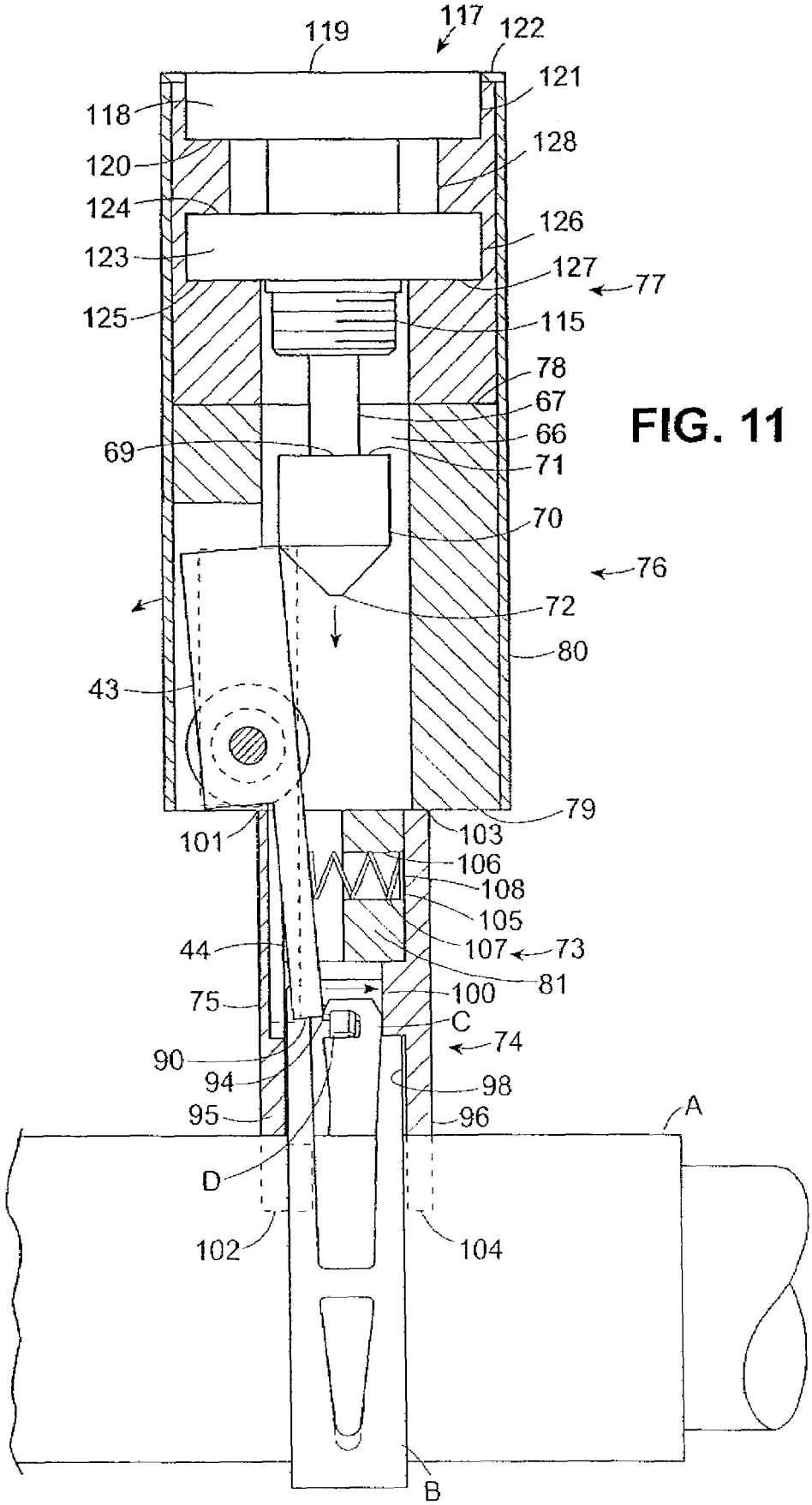
FIG. 11 is a side view of a tool in accordance with an embodiment of the invention showing the movement of the actuating means and releasing means.
Figure 12A:
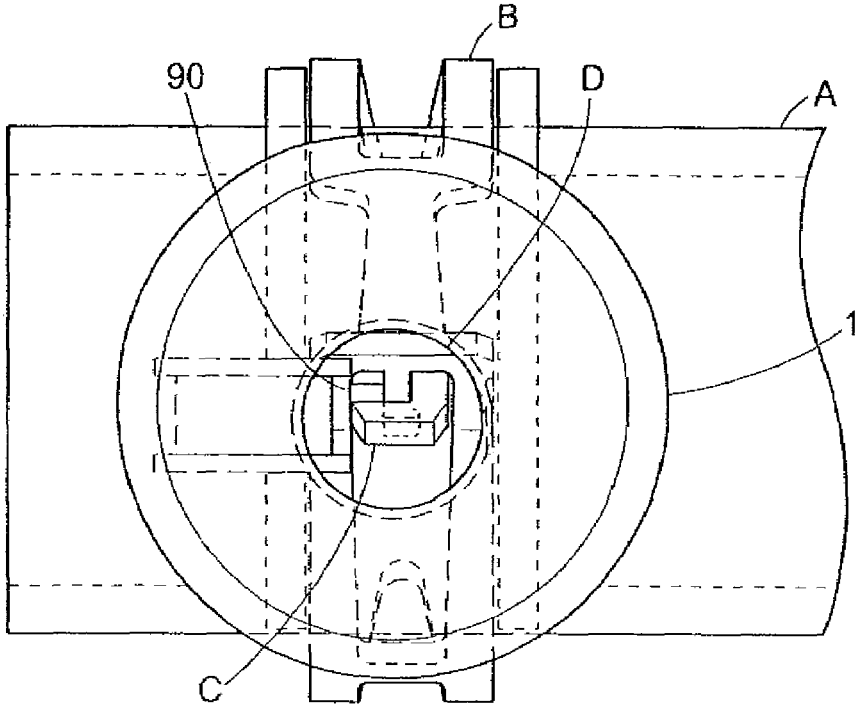
FIG. 12A is a top view of a tool in accordance with an embodiment of the invention.
Figure 12B:
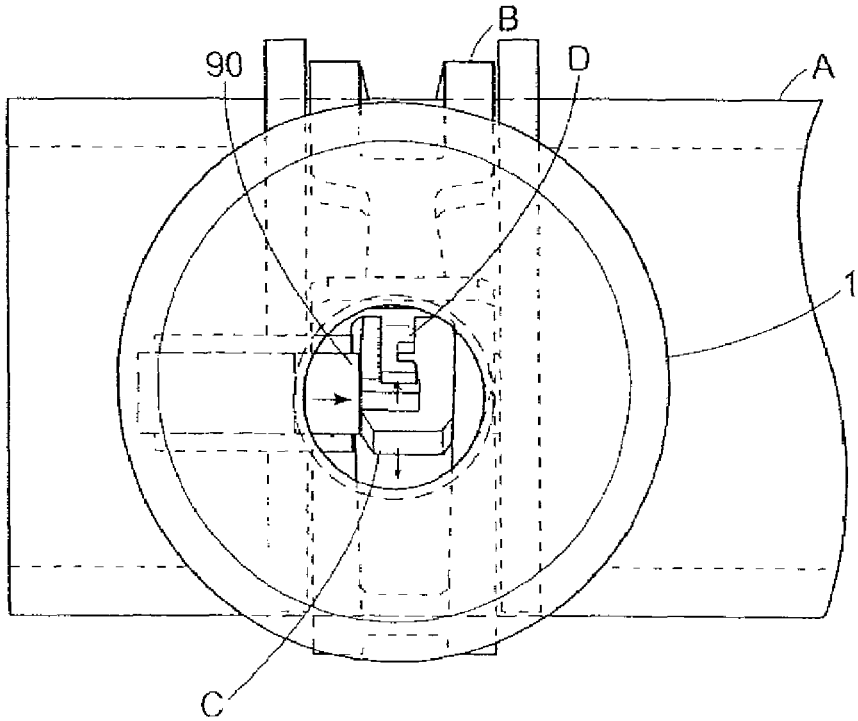
FIG. 12B is a top view of a tool in accordance with an embodiment of the invention showing the movement of the releasing means.

Referring particularly to FIG. 10-11, the first body in this embodiment comprises a) a curved section piece 73, which preferably is comprised of a first plate 74 and a second plate 75, b) a main piece 76, and c) a second body mount 77. The main piece 76 has a main piece upper end 78, a main piece lower end 79 and one or more main piece side surfaces 80. The first body may be formed by releaseably securing the second body mount to the main piece either at the main piece upper end or at a point at one or more of the main piece side surfaces which correspond to an annular opening. The second body mount is preferably releaseably secured to the main piece by second body mount fastening means, such as bolts or screws with corresponding threaded bore holes, screw threads, friction fittings, latches, pins, nuts and bolts, hook and loop (VELCRO® type) fasteners and the like. The curved section piece is releaseably secured to the main piece lower end by curved section piece fastening means, such as bolts or screws with corresponding threaded bore holes, screw threads, friction fittings, latches, pins, nuts and bolts, hook and loop (VELCRO® type) fasteners and the like. In the embodiment of the invention wherein the curved section piece comprises a first plate and a second plate, the first plate and the second plate are dependently or independently releaseably secured to the main piece by curved section piece fastening means.

Figure 8:
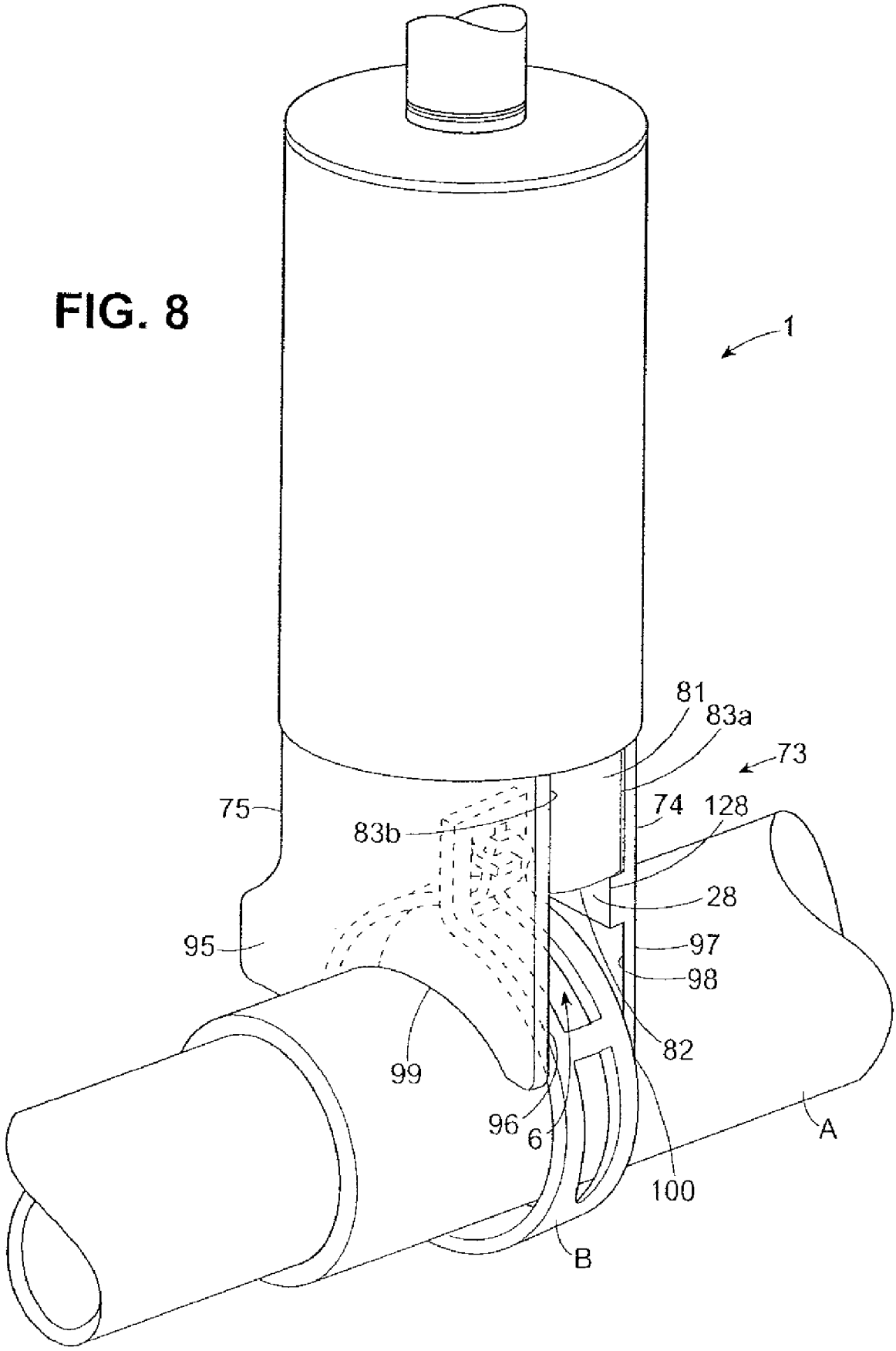
FIG. 8 is a perspective view of a tool in accordance with an embodiment of the invention placed over a hose having a clamp proximate to the bottom opening.
Figure 9:
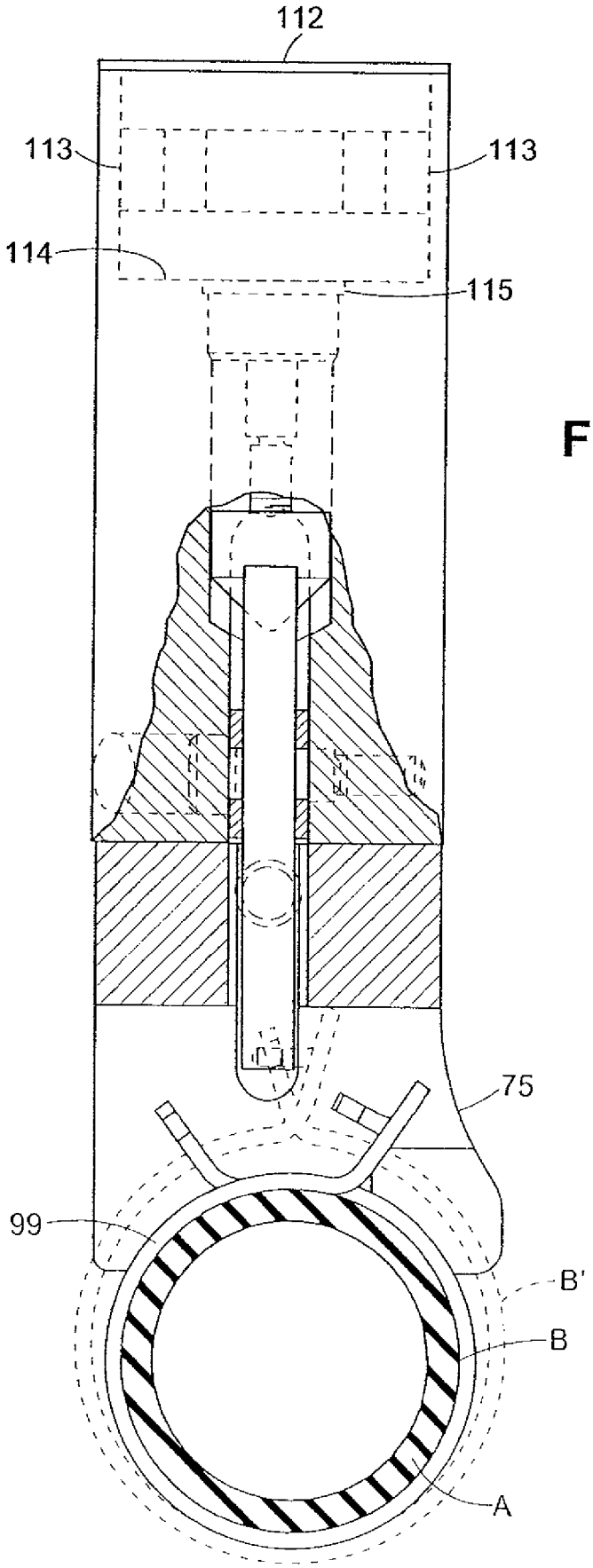
FIG. 9 is a front view of a tool in accordance with an embodiment of the invention placed over a hose having a clamp proximate to the bottom opening with a cut away showing the internal cavity and releasing means with the clamp shown in solid lines having terminal ends disengaged and in dotted lines having the terminal ends engaged.

The main piece may comprise the one or more ports, one or more annular channels, the internal cavity and the releasing means. In the embodiment of the invention shown in the drawings, particularly FIGS. 9-11, for example, the main piece comprises an extended element 81 which protrudes from the main piece lower end and is generally aligned in an axial direction with the internal cavity 28. The extended element 81 may comprise all or part of the internal cavity 28. The extended element 81 has an extended element lower surface 82 and one or more extended element side surfaces, such as an extended element first side surface 83*a* and an extended element second side surface 83*b* as shown in FIG. 8 which may correspond to the geometry of the main piece. For example, when the main piece is generally cylindrical, the extended element will have a continuous side surface and if the main piece is square or rectangular having opposing sides, the extended element may also have opposing sides. The extended element may further comprise one or more main piece bore holes for releaseably securing the curved section piece to the main piece.

In the embodiment of the invention shown in FIGS. 8-12, the main piece comprises part of an annular channel 83 which is perpendicular to and extends from the main piece upper end 78 to the internal cavity 84. In this embodiment, the internal cavity 84 generally has an upper section 84*a* and a lower section 84*b*. As shown in FIG. 10, for example, the first section 43 of the pivoting element 36 is generally within the upper section 84*a* of the internal cavity and the extended section 44 is generally within the lower section 84*b*. Although one annular channel is shown in the drawings, the main piece may have more than one annular channel, or more than one partial annular channel, the number and configuration of which depends on the number and location of the ports. In this embodiment of the invention, the main piece further may comprise one or more, such as four, mount bore holes proximate to the main piece upper end which are part of the second body mount fastening means. Some or all of the mount bore holes may be threaded.

As shown in FIGS. 8-12, and particularly in FIGS. 10-11, the pivoting element in this embodiment of the invention comprises an extended section 44. The first section 43 of the pivoting element has a geometric shape, which may be rectangular having and upper end 85 and a lower end 86. The extended section protrudes from all or part of the lower end, preferably at an edge of the lower end proximate to the internal cavity 84. The pivoting element having an extended section will generally have corresponding sides with surfaces at each side defining edges and corners formed where sides and edges meet. Preferably, the extended section has an edge 87 which corresponds to a side 88 that is adjacent to, and an extension of, a side of the first section of the pivoting element. The extended section 44 has an upper end 89 which is adjacent to the first section and a lower end 90 which is opposite to the upper end and proximate to the internal cavity. When the releasing means is actuated, the lower end 90 of the extension leg comes into contact with the clamp particularly at the impact corner 94. FIGS. 12A and 12B particularly show the impact of the lower end 90 and impact corner 94 coming into contact with the terminal ends (C, D) of the clamp moving the terminal ends (C, D) in opposite directions as shown by the arrows in FIG. 12A, thus releasing the clamp B to a relaxed state applying pressure to the hose B. Likewise, the arrows in FIG. 11 show the impact of the wedge 70 on the pivoting element 36 which causes movement of the lower end 90 of the extended section 44 into the terminal ends (C, D) of the clamp B. Note that in FIG. 9 the clamp is shown as B' in an engaged state with the terminal ends engaged and as B in a relaxed state with the terminal ends released after the clamp is impacted.

In the embodiment shown in FIGS. 9-12, the hole of the pivoting element may be in the upper section and the end of the screw 91 protrudes through the hole maintaining the pivoting element in place and providing for rotational movement around the screw when the releasing means is actuated. The spring 92 in this embodiment of the invention may be within the internal cavity and extends from a point on the internal cavity wall 93 within, as discussed below, a spring well 105 of the extended element 81 to a side of the pivoting element, including the side 88 of the extension leg proximate to the internal cavity as shown in FIGS. 10-11. The spring urges the pivoting element back to its original position after the releasing means is actuated and the pivoting element contacts the clamp.

Referring to FIGS. 8-12, in this embodiment of the invention, the curved section piece comprises a first plate 74 and a second plate 75. The first plate 74 has a first plate outer wall 95 and a first plate inner wall 96, and the second plate 75 has a second plate outer wall 97 and a second plate inner wall 98. In this embodiment each of the first plate and second plate may have one or more plate bore holes (not shown) which correspond to each other. The plate bore holes are defined by plate bore hole walls. As discussed above, the extended element of the main piece also may have one or more bore holes, main piece bore holes, defined by main piece bore hole walls. The first plate and second plate are releaseably secured to the main piece with the first plate inner wall 96 and the second plate inner wall 98 juxtaposed to each other with the one or more plate bore holes aligned with each other and the one or more main piece bore holes using the curved section piece fastening means, such as nuts and bolts or screws and threaded sections on some or all of the plate bore hole walls and main piece bore hole walls.

As shown, particularly in FIGS. 10 and 11, the first plate 74 and second plate 75 are releasably secured (or permanently secured or integral with the main piece) at the extended element 81. The first plate 75, has an upper end 101 and lower end 102 and the second plate 75 has an upper end 103 and a lower end 104. Particularly, as shown in FIGS. 10-11, when the first plate and second plate interface with the main piece, the first plate inner wall 96 proximate to the upper end 101 is adjacent to and juxtaposed with a surface of the extended element 81 and the second plate inner wall 98 proximate to the upper end 103 is adjacent to and juxtaposed with a surface of the extended element 81. Further, the extended element 81 may comprise a spring well 105 which is defined by a spring well upper wall 106, a spring well lower wall 107 and a spring well back wall 108 wherein the spring is partially within the spring well 105.

The lower end 102 of the first plate 74 and the lower end 104 of the second plate 75 are arcuate having curvature. When the first plate 74 and second plate 75 are attached to each other, the lower ends of the first plate and second plate form the curved end having the arcuate surface as described above. The curved section piece further comprises the bottom opening 6. The interchangeable curved section piece allows the tool to be used with various curved sections having a different curvature, i.e. larger or smaller arcuate surfaces, corresponding to various size hoses, such as standard size hoses for automobiles, and these different curved section pieces would be used for different size hoses but may be applied to the main piece of the tool. Also, as shown in FIGS. 8-11 the tool may comprise the bump-out 129 at the upper end 101 of the second plate 75 adjacent to the second plate inner wall 98 and proximate to the extended element 81 with the bump-out 100 having similar design and function as described above with respect to bump-outs generally and in the other embodiments of the invention described herein.

The second body 77 mount generally has the same geometric shape as the main piece; however, it is not necessary that it has the same geometric shape. In the embodiment of the invention shown in FIGS. 8-12, the second body mount is cylindrical having an outer wall 109, an upper end 110 and a lower end 111. The second body mount further comprises a well 112 defined by a well inner wall 113 and a well bottom 114. The well bottom comprises a port 115 at about the center of the well bottom, and the port in the second body mount may comprise screw threads. The second body mount may further comprise one or more mount bore holes, defined by mount bore hole walls, which correspond to one or more upper bore holes on the upper end of the main piece, defined by upper bore hole walls. The mount bore holes and upper bore holes accommodate the second body mount fastening means, as described above, including screws and threaded sections on some or all of the mount bore hole walls and upper bore hole walls.

The second body mount may comprise all or part of an annular opening adjacent to the port (the annular opening as shown in FIGS. 10-11 as 116 and extends to the main piece). The second body mount is releaseably secured to the main piece by placing the second body mount at the upper end of the main piece with the lower surface of the second body mount juxtaposed with the upper end of the main piece with the mount bore holes aligned with the upper bore holes and applying the second body mount fastening means to the mount bore holes and upper bore holes. In this embodiment, the port, or any section of the annular channel 116 within the second body mount, is axially aligned to the section of the annular channel 116 within the main piece. The second body may be releaseably secured to the first body by placing the attaching end of the second body within the port in the well with all or part of the outer wall of the second body juxtaposed with the well inner wall.

In an embodiment of the invention as shown in FIGS. 8-12, the second body 117 may have two enlarged sections. A first enlarged section, having a top 119, bottom 120 and continuous side surface 121 is adjacent to the first end 122 of the second body, and a second enlarged section 123, having a top 124, a bottom 125 and a continuous side surface 126 is proximate to the attaching end 127. The enlarged sections have a dimension, in a direction perpendicular to the well inner wall of second body mount, slightly less than the distance on one point of the well inner wall directly across an opposite point of the well inner wall, which inhibits movement of the second body within the well during use of the tool, and facilitates alignment of the second body attaching end with the port. Between the enlarged sections is a midsection 128 which may have a smaller diameter than the enlarged sections. As discussed above, the second body comprises the actuating means which as shown in the drawings comprises piston element 66 with a shaft 67 and wedge 70, the actuating means having the same features, elements and function as discussed above with respect to the invention and the other embodiments discussed herein.

The interchangeable second body mount allows the tool to be used with different types and sizes of activating means and actuating means. This provides the tool with versatility.

In another embodiment of the invention, the first body comprises extension sleeves proximate to one or more of the ports of the first body. The extension sleeves have a forward end, a distal end, an outer surface and an inner surface which defines a sleeve opening. The forward end and/or distal end may be open such that the extension sleeve is an annular tube, open at one end and proximate to and/or attached to the outer surface of the main body at the other end. In this embodiment, the second body is releaseably attached to the port such that the outer wall of the second body is juxtaposed with the inner surface of the sleeve.

The tool is used in a method for releasing hose clamps. The tool is placed on the hose in the area of the clamp, within the curved end adjacent to the hose such that the clamp is within the bottom opening and the convex curved section is aligned with and preferably resting at, near or proximate to the outer surface of the hose. The actuating means is activated which causes the releasing means to release the terminal ends of the clamp. Once the clamp is in its relaxed position the tool is removed from the hose. Because the bottom opening is perpendicular to the axial alignment of the curved end, such as the arcuate surface of the curved section piece, the tool aligns the releasing means with the terminal ends of the clamp to ensure that the pivoting element will impact one or more of the terminal ends squarely thereby decreasing the potential for the pivoting element to miss the terminal end when the releasing means is actuated or to cause the clamp to shift when the terminal ends are released. Also, because the curved end is aligned with the outer curvature of the hose, the hose clamp at its terminal ends is effectively cradled within the bottom opening with the terminal ends within the bottom opening which limits the movement of the terminal ends after releasing, other than the axial movement of each terminal end away from each other when the clamp moves to its relaxed position and also limits movement of the clamp when the releasing means contacts the clamp and while the clamp is moving to its relaxed state applying radial pressure to the hose.

In use, the second body is releaseably secured to the first body in a port which facilitates accessing the clamp. Also, in the embodiment of the invention wherein the first body comprises interchangeable parts, the parts are selected to facilitate use of the tool depending on hose size and power needs for actuating the releasing means.

Figure 13:
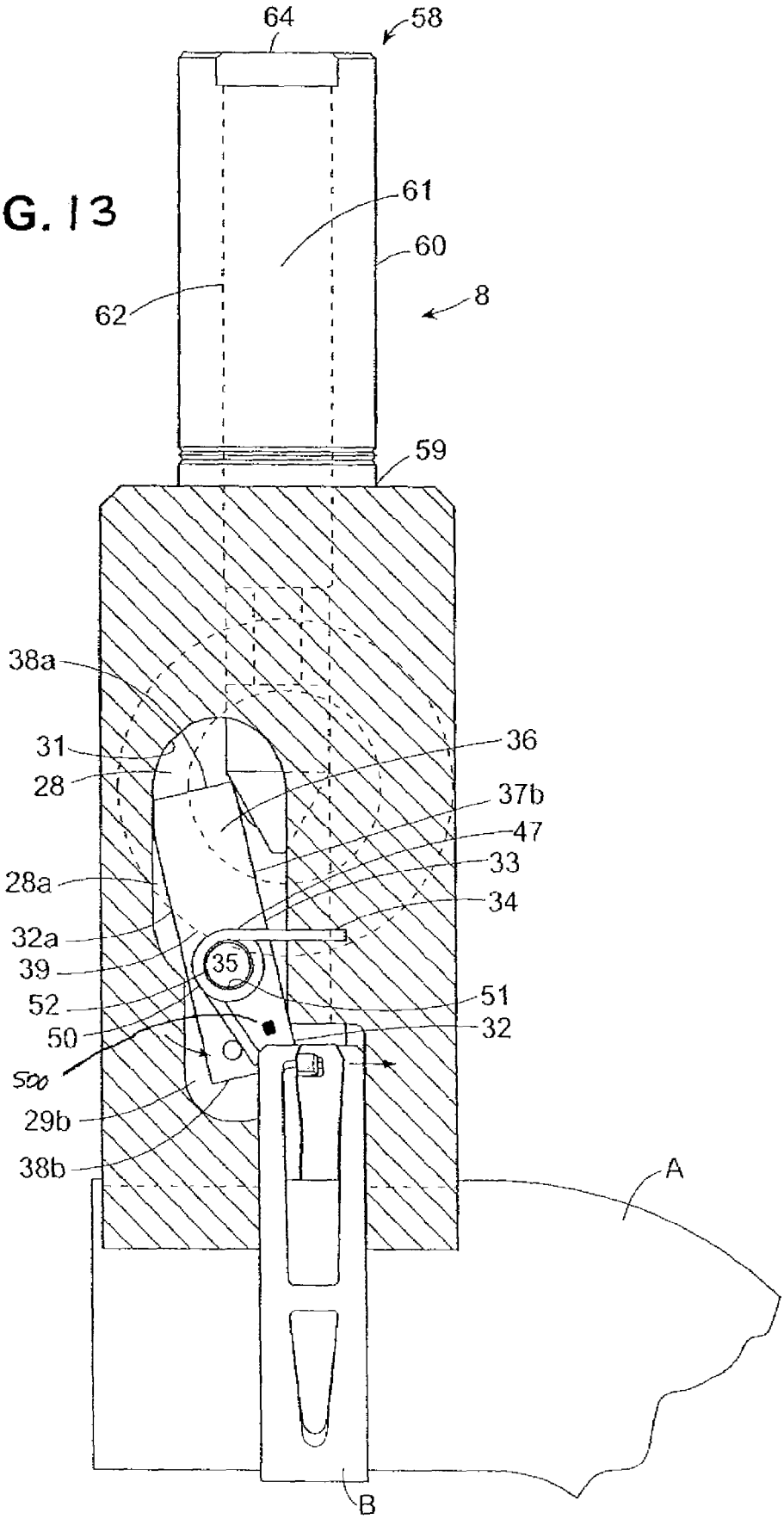
FIG. 13 is a cross sectional view of a tool in accordance with an embodiment of the invention wherein a strain gauge is attached to the pivoting element.
Figure 14:
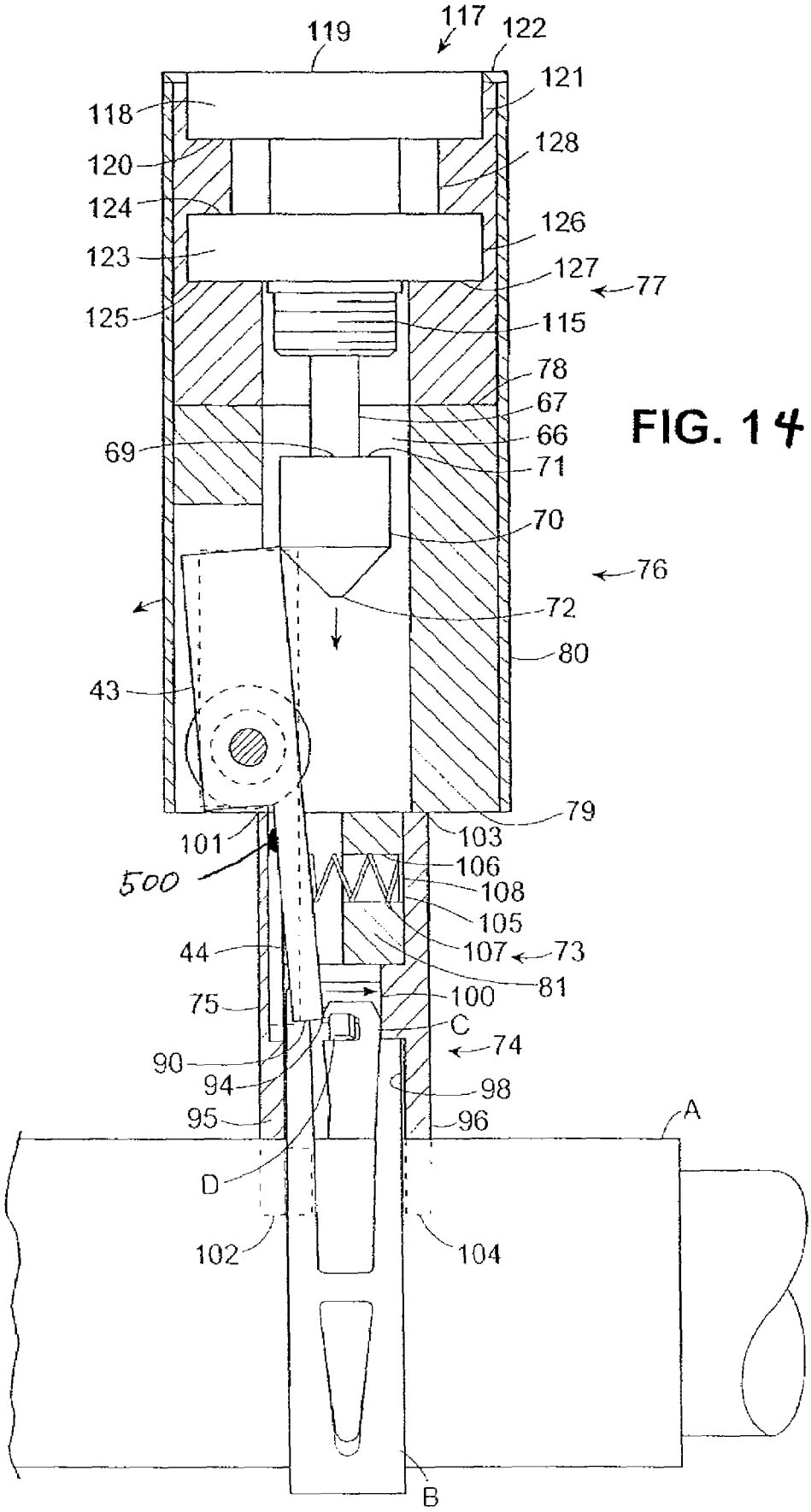
FIG. 14 is a cross sectional side view of a tool in accordance with an embodiment of the invention wherein a strain gauge is attached to the extended section of the pivoting element.

In embodiments of the invention, the tool for releasing the hose clamp comprises a sensor which indicates that the engaged terminal ends of the clamp are released to provide the tool operator with confirmation that the tool has accomplished its purpose. Any sensor that can detect the movement of the terminal ends of the hose clamp may be used as part of or in conjunction with the tool. Exemplary sensors are strain gauges, proximity switches, light sensors and combinations thereof. These sensors are generally incorporated into a functional element of the tool, such as the releasing means, like the pivoting element, or a component of the pivoting element like the extended section, and are preferably located at the releasing means at a location proximate to the point where the releasing means contacts the clamp. For example, as shown in FIGS. 13 and 14 the strain gauge 500 may be located on the lower part of the pivoting element below the pivoting point near where the pivoting element enters the bottom opening and where the pivoting elements impacts the clamp.

The most preferred sensor is a strain gauge, such as that available from B&Q Technical Service, Inc., Wiallingford, Pa., USA. A strain gauge generally comprises a wire and measures the resistance in the wire. When the wire is bent the resistance changes and the change in resistance is read through a processor, such as The Brick available from Specialty Measurements, Inc., Lebanon, N.J., USA, that turns the signal into a voltage that is amplified and increased to a readable level as well as conditioned for signal noise and digitized so that the information can be seen with the use of a computer. In this embodiment of the invention, the tool comprises a strain gauge 500 secured to the releasing means, such as pivoting element 36 (FIG. 13) and may be at or proximate to the extended section 44 of the pivoting element (FIG. 14). For example, in FIG. 14, as well as the other drawings (such as FIGS. 10-11), the pivoting element 36, including the first section 43 and extended element 44 has a side or thickness perpendicular or about perpendicular to the face shown in the drawing and in this embodiment of the invention the strain gauge 500 is as shown located on this perpendicular side or thickness and is thus at the extended section 44 on the side or thickness that is perpendicular to or about perpendicular to the face shown on the drawing more proximate to the first section 43 of the pivoting element 36 than the lower end 90. When the releasing means, such as the pivoting element, impacts one of the terminal ends of the clamp, it bends which is sensed by the strain gauge which sends a signal to the processor. The operator can then check with the processor, such as reading the output of the processor, to confirm that the releasing means has impacted one or more of the terminal ends of the clamp to ensure that the terminal ends have been released.

Although a light sensor or proximity switch may be used, the strain gauge may provide a more precise confirmation that the tool has released the terminal ends of the clamp because the proximity switch or light sensor may detect any piece of metal moving, and thus can be by-passed. The strain gauge cannot be by-passed because the operator can program or calibrate the strain gauge and sensor through the processor for the amount of force required to release a clamp therefore creating a window of force that the processor checks for against the signal received from the strain gauge. If the proper force is not detected by and sent to the processor, the processor can be programmed to record a file. The operator can check for files to determine which clamps have not been properly impacted by the tool. Different amounts of force can be programmed depending on the type and size of clamp.

In an embodiment of the invention, the strain gauge can be used with other sensors to create data which identifies which vehicles may not have a properly released clamp. A first sensor, a preferably a proximity switch, is used in conjunction with a device to identify a vehicle through the Vehicle Identification Number ("VIN") by reading the VIN through scanning. A second sensor, such as a strain gauge is used in conjunction with the tool comprising the strain gauge as described above. A third sensor, preferably a proximity switch, is used to identify the vehicle leaving the work area. If the strain gauge does not read the appropriate force which indicates that the clamp has been impacted and/or if the third sensor indicates the vehicle is leaving the work area without any reading from sensor thus indicating that the tool was never activated to release the clamp, a file or record is created which allows the manufacturer or repair shop to know the precise vehicle which may not have the clamp properly installed.

The invention concerns a tool for releasing a hose clamp wherein the tool comprises a curved end having an arcuate convex curved section with an arcuate surface having an uppermost point opposite to a bottom plane of the curved end wherein the curved end is capable of fitting juxtaposed to the outer surface of the hose when the clamp is released.

The invention further concerns a tool for releasing clamps comprising a. a first body having a first end, a curved end having an arcuate convex curved section with an arcuate surface having an uppermost point opposite to a bottom plane of the curved end, one or more outer surfaces, one or more ports, a bottom opening proximate to the curved end and perpendicular to the uppermost point defined by a bottom opening forward wall, bottom opening upper wall and a bottom opening distal wall, an internal cavity defined by an internal cavity wall which is discontinuous proximate to the bottom opening and one or more annular channels defined by one or more inner channel annular walls which extend from each port to the internal cavity and a releasing means within the internal cavity; and b. a second body having a first end, an attaching end and an annular inner tube defined by an annular inner tube wall which extends from the first end of the second body to the attaching end and actuating means within the inner tube wherein each port and the attaching end of the second body comprise means to releaseably secure the second body to the ports of the first body.

The invention also concerns a method for releasing the terminal ends of a hose clamp comprising the steps of applying a hose with a clamp with engaged terminal ends around an outer surface of the hose to a functional element, placing the curved end of the tool described herein over the outer surface of the hose with the curved end aligned so that the terminal ends of the hose clamp are within the bottom opening, activating the actuating means and removing the tool from the hose after the clamp is in the relaxed position. The invention further comprises this method wherein actuating means is activated by pneumatic means and a method wherein the functional element is a component of an automobile.

What is claimed is:

1. A tool for releasing a clamp having at least one terminal end, the tool comprising:

a) a first body having a first end, a curved end having an arcuate convex curved section with an arcuate surface having an uppermost point opposite to a bottom plane of the curved end, one or more outer surfaces, one or more ports, a bottom opening proximate to the curved end and perpendicular to the uppermost point defined by a bottom opening forward wall, bottom opening upper wall and a bottom opening distal wall, an internal cavity defined by an internal cavity wall which is discontinuous proximate to the bottom opening and one or more annular channels defined by one or more inner annular channel walls which extend from each port to the internal cavity and a releasing means within at least the internal cavity; and b) a second body having a first end, an attaching end and an annular inner tube defined by an annular inner tube wall which extends from the first end of the second body to the attaching end; and c) actuating means wherein each port and the attaching end of the second body comprise means for releasably securing the second body to one of the ports of the first body.

2. The tool of claim 1 wherein the second body comprises the actuating means.

3. The tool of claim 1 further comprising one or more bump outs in the bottom opening.

4. The tool of claim 1 wherein the releasing means comprises a pivoting element which comes into contact with the clamp.

5. The tool of claim 1 wherein the releasing means further comprises a spring.

6. The tool of claim 1 wherein the actuating means comprises a piston element that is capable of sliding within one of the annular inner tubes.

7. The tool of claim 6 wherein the piston element comprises:

a) a cylindrical shaft having a rearward end and a forward end; and b) a wedge having a first end adjacent to the forward end of the shaft and a second end.

8. The tool of claim 6 wherein the annular inner tube is aligned with one of the annular channels of the first body such that the piston element is capable of sliding axially within the annular inner tube and annular channel.

9. The tool of claim 1 wherein the first body comprises a main piece having a main piece upper end, a main piece lower end and an extended element at the main piece lower end, and a second body mount comprising a port and having an upper end, a lower end and a well at the upper end defined by a well inner wall and a well bottom and the curved end comprises a curved section piece having a first plate with a first plate outer wall and a first plate inner wall, and a second plate with a second plate outer wall and a second plate inner wall wherein the second body mount is secured or releasably secured to the main piece at the main piece upper end and the first plate and second plate are secured or releaseably secured to the main piece proximate to the extended element such that the first plate inner wall and second plate inner wall are juxtaposed.

10. The tool of claim 9 comprising a bump out at the second plate inner wall proximate to the extended element.

11. The tool of claim 9 wherein the second body is within the well of the second body mount.

12. The tool of claim 1 further comprising a sensor selected from the group consisting of a strain gauge, a proximity switch and a light sensor to indicate when at least one terminal end of the clamp is released.

13. The tool of claim 12 wherein the sensor is a strain gauge secured to the releasing means.

14. A method for applying a hose with a clamp with engaged terminal ends around an outer surface of the hose to a functional element at a work area, comprising the steps of:

a) providing the tool of claim 1;

b) placing the curved end of the tool over the outer surface of the hose with the curved end aligned so that the terminal ends of the hose clamp are within the bottom opening, c) applying an activating means to activate an actuating means of the tool to actuate a releasing means of the tool which moves at least one of the terminal ends of the clamp to release the clamp from an engaged position to a relaxed position; and d) removing the tool from the hose.

15. The method of claim 14 wherein the activating means is pneumatic.

16. The method of claim 14 comprising the additional step of using the tool in conjunction with a first sensor, a second sensor and a third sensor wherein the functional element is a component of a vehicle having a vehicle identification number and the first sensor detects the vehicle identification number of the vehicle, the second sensor is a strain gauge to detect whether the terminal ends of the clamp have been released from the engaged position to the relaxed position and third sensor detects the vehicle leaving the work area.

* * * * *